US007755580B2

(12) United States Patent
Mas et al.

(10) Patent No.: US 7,755,580 B2
(45) Date of Patent: Jul. 13, 2010

(54) AUTOMATED ADAPTATION OF THE SUPPLY VOLTAGE OF A LIGHT-EMITTING DISPLAY ACCORDING TO THE DESIRED LUMINANCE

(75) Inventors: Céline Mas, Poisat (FR); Eric Benoit, Quaix en Chartreuse (FR); Olivier Scouarnec, Saint Ismier (FR); Olivier Le Briz, Saint-Gervais (FR); Danika Chaussy, Brie et Angonnes (FR); Philippe Maige, Seyssinet-Pariset (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/917,846

(22) Filed: Aug. 13, 2004

(65) Prior Publication Data

US 2005/0035933 A1 Feb. 17, 2005

Related U.S. Application Data

(63) Continuation of application No. 10/622,416, filed on Jul. 18, 2003, now abandoned.

(30) Foreign Application Priority Data

Jul. 19, 2002 (FR) ..... 02 09227

(51) Int. Cl.
*G09G 3/32* (2006.01)
*G09G 3/30* (2006.01)
*G09G 3/10* (2006.01)

(52) U.S. Cl. ..... 345/82; 345/77; 315/169.1

(58) Field of Classification Search ..... 345/46, 345/55, 76, 82, 84, 204, 212; 315/169.3, 315/225, 302; 330/252
See application file for complete search history.

(56) References Cited

U.S. PATENT DOCUMENTS 3,207,998 A * 9/1965 Corney et al. ..... 330/11
5,594,463 A 1/1997 Sakamoto
5,684,368 A * 11/1997 Wei et al. ..... 315/302

(Continued)

FOREIGN PATENT DOCUMENTS

EP 0 573 822 A 12/1993

(Continued)

OTHER PUBLICATIONS

French Search Report from French Patent Application 02/09227, filed Jul. 19, 2002.

(Continued)

*Primary Examiner*—Sumati Lefkowitz
*Assistant Examiner*—William L Boddie
(74) *Attorney, Agent, or Firm*—Lisa K. Jorgenson; James H. Morris; Wolf, Greenfield & Sacks, P.C.

(57) ABSTRACT

A method for regulating the biasing voltage of column control circuits of an array screen formed of LEDs distributed in lines and columns, the column control circuits being adapted to turning on at least one LED of a line. The method includes increasing the biasing voltage when the current flowing through at least one activated LED is smaller than a determined luminance current and of decreasing the biasing voltage when the current flowing through each activated LED is equal to the determined luminance current.

22 Claims, 6 Drawing Sheets

U.S. PATENT DOCUMENTS

| | | | | |
|---|---|---|---|---|
| 5,708,391 | A * | 1/1998 | Altmann et al. | 330/252 |
| 5,726,679 | A | 3/1998 | Kanno et al. | |
| 5,929,831 | A | 7/1999 | Aratani et al. | |
| 6,259,615 | B1 * | 7/2001 | Lin | 315/225 |
| 6,433,488 | B1 * | 8/2002 | Bu | 345/212 |
| 6,518,962 | B2 * | 2/2003 | Kimura et al. | 345/211 |
| 6,710,548 | B2 * | 3/2004 | Kimura | 315/169.3 |
| 6,756,951 | B1 * | 6/2004 | Ishizuka et al. | 345/82 |
| 6,774,723 | B2 * | 8/2004 | Sabouri | 330/288 |
| 6,995,737 | B2 * | 2/2006 | LeChevalier | 345/82 |
| 7,042,427 | B2 * | 5/2006 | Inukai | 345/77 |
| 2001/0026285 | A1 | 10/2001 | Toffolo et al. | |
| 2001/1043206 | | 11/2001 | Naito et al. | |
| 2002/0154101 | A1 * | 10/2002 | Abe et al. | 345/204 |
| 2006/0001613 | A1 * | 1/2006 | Routley et al. | 345/76 |

FOREIGN PATENT DOCUMENTS

| | | |
|---|---|---|
| EP | 1 156 469 A | 11/2001 |

OTHER PUBLICATIONS

French Search Report from related French Patent Application 02/09228, filed Jul. 19, 2002.

French Search Report from related French Patent Application 02/09229, filed Jul. 19, 2002.

Patent Abstracts of Japan vol. 2000, No. 15, Apr. 6, 2001 & JP 2000 347613 A (Mitsubishi Electric Corp.).

Patent Abstracts of Japan, vol. 2000, No. 01, Jan. 31, 2000 & JP 11 272223 A (Toyota Motor Corp.).

* cited by examiner

AUTOMATED ADAPTATION OF THE SUPPLY VOLTAGE OF A LIGHT-EMITTING DISPLAY ACCORDING TO THE DESIRED LUMINANCE

CROSS REFERENCE TO RELATED APPLICATIONS

This application is a continuation of application Ser. No. 10/622,416, filed Jul. 18, 2003, entitled AUTOMATED ADAPTATION OF THE SUPPLY VOLTAGE OF A LIGHT-EMITTING DISPLAY ACCORDING TO THE DESIRED LUMINANCE, which prior application is incorporated herein by reference.

BACKGROUND OF THE INVENTION

1. Field of the Invention

The present invention relates to light-emitting display array screens formed of an assembly of light-emitting diodes (LEDs). These are, for example, screens formed of organic diodes ("OLED", for Organic Light-Emitting Display) or polymer diodes ("PLED", for Polymer Light-Emitting Display). The present invention more specifically relates to the regulation of the supply voltage of the circuits controlling the LEDs of such screens.

2. Discussion of the Related Art

FIG. 1 shows an array screen comprised of n columns $C_1$ to $C_n$ and k lines $L_1$ to $L_k$ enabling addressing of n*k LEDs d, the anodes of which are connected to a column and the cathodes of which are connected to a line.

Line control circuits $CL_1$, to $CL_k$ enable respectively biasing lines $L_1$ to $L_k$. Only a single line is activated at a time, and is grounded. The non-activated lines are biased to a voltage $V_{line}$.

Column control circuits $CC_1$ to $CC_n$ enable respective biasing of columns $C_1$ to $C_n$. The columns addressing the LEDs which are desired to be activated are biased by a current to a voltage $V_{col}$ greater than the threshold voltage of the LEDs of the screen. The columns which are not desired to be activated are grounded.

An LED connected to the activated line and to a column biased to $V_{col}$ is then on and emits light. Voltage $V_{line}$ is provided to be sufficiently high so that the LEDs connected to the non-activated lines at voltage $V_{col}$ and to the columns are not conductive and do not emit light.

FIG. 2 shows a column control circuit CC and a line control circuit CL respectively addressing a column C and a line L connected to an LED d of the screen. Line control circuit CL comprises a power inverter 1 controlled by a line control signal $\phi_L$. Power inverter 1 comprises an NMOS transistor 2 enabling discharge of line L when $\phi_L$ is high and a PMOS transistor 3 enabling charging line L to bias voltage $V_{line}$ when $\phi_L$ is low.

Column control circuit CC comprises a current mirror formed in the present example with two transistors 4, 5 of type PMOS. Transistor 4 forms the reference branch of the mirror and transistor 5 forms the duplication branch. The sources of transistors 4 and 5 are connected to a biasing voltage $V_{pol}$ on the order of 15 V for OLED screens. The gates of transistors 4 and 5 are connected to each other. The drain and the gate of transistor 4 are connected to each other. Transistor 4 is thus diode-assembled, the source-gate voltage ($Vsg_4$) being equal to the source-drain voltage ($Vsd_4$). The current conducted by transistor 4 is set by a current source 6 connected to the drain of transistor 4. Current 6 provides a so-called "luminance" current $I_1$. The drain of transistor 5 is connected to column C via a column selection circuit formed of a PMOS transistor 7 and of an NMOS transistor 8. The source of PMOS transistor 7 is connected to the drain of transistor 5 and the drain of transistor 7 is connected to column C. The source of transistor 8 is grounded and its drain is connected to column C. A column control signal $\phi_C$ is connected to the gate of PMOS transistor 7 and to the gate of NMOS transistor 8. When column control signal $\phi_C$ is high, transistor 8 discharges column C. When it is low, transistor 7 is on and column C charges to reach voltage $V_{col}$. When line L and column C are activated, line control signal $\phi_L$ and column control signal $\phi_C$ are respectively high and low, LED d is on and the current flowing through the diode is equal to luminance current $I_1$.

However, for column control circuit CC to operate as described previously, it is necessary for voltage $V_{pol}$ to be sufficiently high for the copy of current $I_1$ to be correct. Biasing voltage $V_{pol}$ is equal to the sum of source-drain voltage $Vsd_2$ of transistor 2, of voltage $V_d$ across LED d, of source-drain voltage $Vsd_7$ of transistor 7, and of source-drain voltage $Vsd_5$ of transistor 5.

When the copy of current $I_1$ is correct, transistor 5 is in saturation state and voltage $Vsd_5$ is at least equal to source-drain voltage $Vsd_4$ of transistor 4. A correct copy thus imposes requires for biasing $V_{pol}$ to be at least equal to the previously-mentioned sum when the current flowing therethrough is equal to luminance current $I_1$. If biasing voltage $V_{pol}$ is too low, the current flowing through LED d is smaller than current $I_1$ and the luminance of the diodes is insufficient.

Luminance current $I_1$ provided by current source 6 may generally vary according to the luminance desired for the screen. When luminance current $I_1$ increases, source-drain voltage $Vsd_4$ of diode-assembled transistor 4 increases and voltage $V_d$ of light-emitting diode d also increases. As a result, biasing voltage $V_{pol}$ must be sufficiently high for transistor 5 to be in saturation whatever the luminance current.

However, in a concern for electric power saving, biasing voltage $V_{pol}$ is desired to be reduced, which then enables reducing voltage $V_{line}$ of the line control circuits.

There exist control circuits which have a fixed biasing voltage $V_{pol}$ determined according to the maximum desired luminance current $I_1$. The disadvantage of such circuits is their large electric power consumption.

There exist other control circuits for which biasing voltage $V_{pol}$ varies according to the desired luminance current $I_1$. If current I1 is low, voltage Vpol is low, and conversely. However, it is necessary to provide a security margin to take the aging of the LEDs of the screen into account. Indeed, for an equal current in LED d, voltage $V_d$ across the diode increases along time. For a same luminance, the necessary minimum biasing voltage $V_{pol}$ thus progressively increases along time. The power savings obtained for these circuits are thus not optimal.

SUMMARY OF THE INVENTION

An object of the present invention is to provide a column control circuit, biasing voltage $V_{pol}$ of which is as small as possible whatever the aging of the LEDs of the screen.

Another object of the present invention is to provide a control circuit of simple structure.

To achieve these objects, the present invention provides a device for regulating the biasing voltage of column control circuits of an screen array made of LEDs distributed in lines and columns, the column control circuits comprising a current mirror having a reference branch and several duplication branches connected to the biasing voltage, each duplication branch being coupled to a column of the screen, the reference branch being connected at a reference node to a reference current source providing a desired luminance current, said device comprising: first measuring means providing a first signal representative of the voltage of at least one of the columns; second measuring means providing a second signal representative of the voltage of the reference node; and an adjustment circuit receiving the first and second signals and being adapted to increase the biasing voltage when the first signal is higher than the second signal and conversely.

According to an embodiment of such a device, each branch of the current mirror includes a PMOS field effect transistor, having a source connected to the biasing voltage, the gates of each branch being connected together, the drain and the gate of the transistor of the reference branch being connected to the reference current source, the drains of the transistors of the duplication branches being connected to the columns.

According to an embodiment of such a device, first measuring means comprise for each column a diode having an anode connected to the column and having an cathode connected to a first observation current source and to a first input of the adjustment circuit, and wherein the second measuring means comprise a diode having an anode connected to the reference node and a cathode connected to a second observation current source and to a second input of the adjustment circuit.

According to an embodiment of such a device, the cathodes of all the diodes are connected to the first input of the adjustment circuit by a switch, a capacitor being connected between the first input of the adjustment circuit and a fixed voltage node.

According to an embodiment of such a device, the adjustment circuit comprises an error amplifier receiving the first signal on a positive input and receiving the second signal on a negative input, an output of error amplifier being connected to a D.C./D.C. voltage converter outputting the biasing voltage and being adapted to increase the biasing voltage when the first signal is higher than the second signal and conversely.

According to an embodiment of such a device, error amplifier comprises first and second PMOS transistors having their gates respectively connected to positive and negative inputs of the error amplifier, the source of each one of the first and second transistors being connected to the biasing voltage by a current source, the sources of first and second transistors being connected by a resistor, the drains of first and second transistors being connected to a converter providing the error signal, the source and drain of a third PMOS transistor being connected to the source and drain of the first transistor, the gate of the third transistor being connected to a fixed voltage.

The present invention also provides a method for regulating the biasing voltage of column control circuits of an screen array made of LEDs distributed in lines and columns, the column control circuits comprising a current mirror having a reference branch and several duplication branches connected to the biasing voltage, each duplication branch being coupled to a column of the screen, the reference branch being connected at a reference node to a reference current source providing a desired luminance current, comprising the following steps: providing a first signal representative of the voltage of at least one of the columns; providing a second signal representative of the voltage at the reference node; and increasing the biasing voltage when the first signal is higher than the second signal and conversely.

According to an embodiment of such a device, the first signal is an image of the maximum voltage of the activated LEDs.

The foregoing objects, features and advantages of the present invention, will be discussed in detail in the following non-limiting description of specific embodiments in connection with the accompanying drawings.

DETAILED DESCRIPTION

Figure 1:
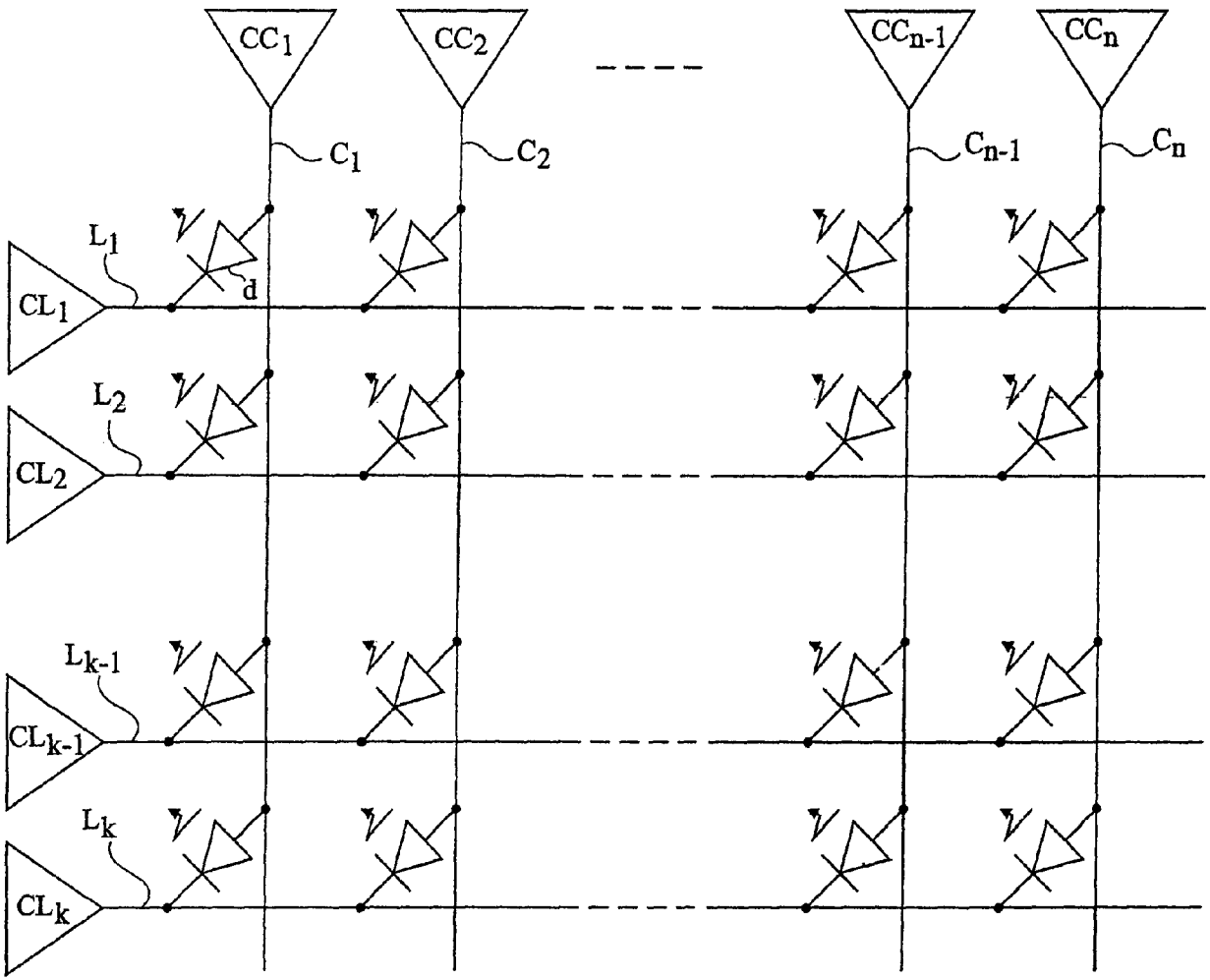
Fig 1 Prior Art
FIG. 1, previously described, shows a light-emitting array display.
Figure 2:
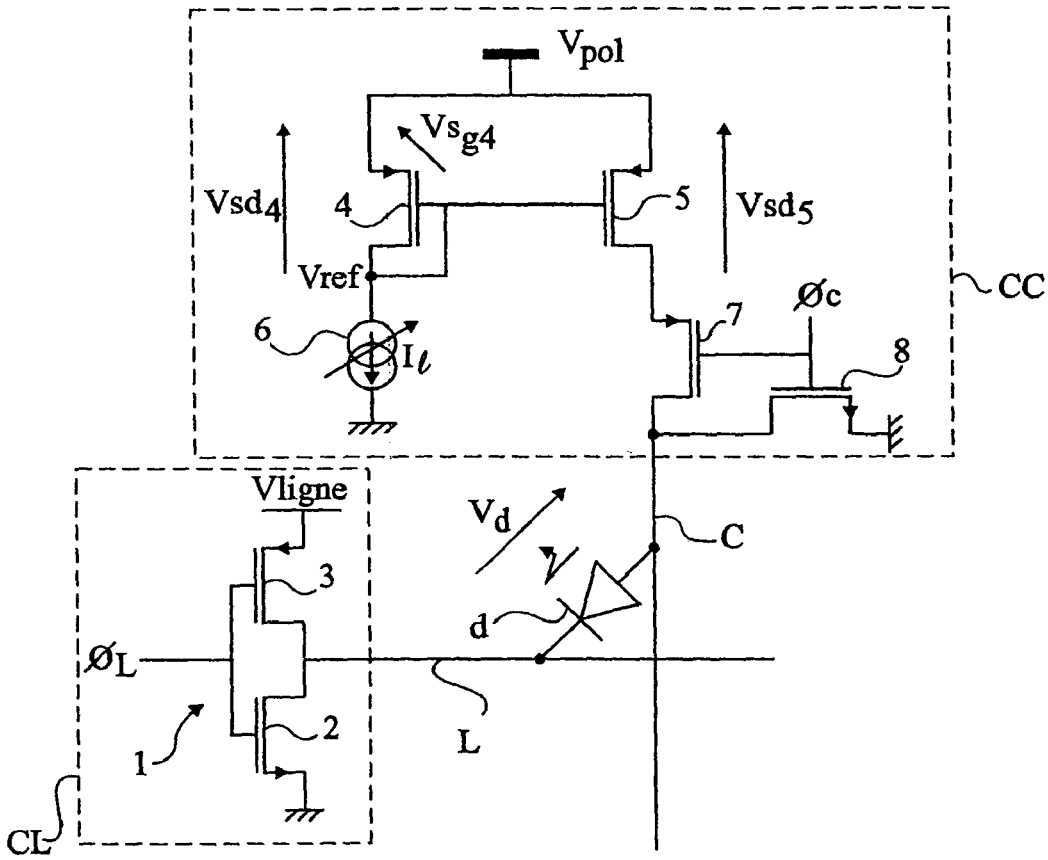
Fig 2 Prior Art
FIG. 2, previously described, shows a column control circuit and a line control circuit addressing a an LED of a screen.
Figure 3:
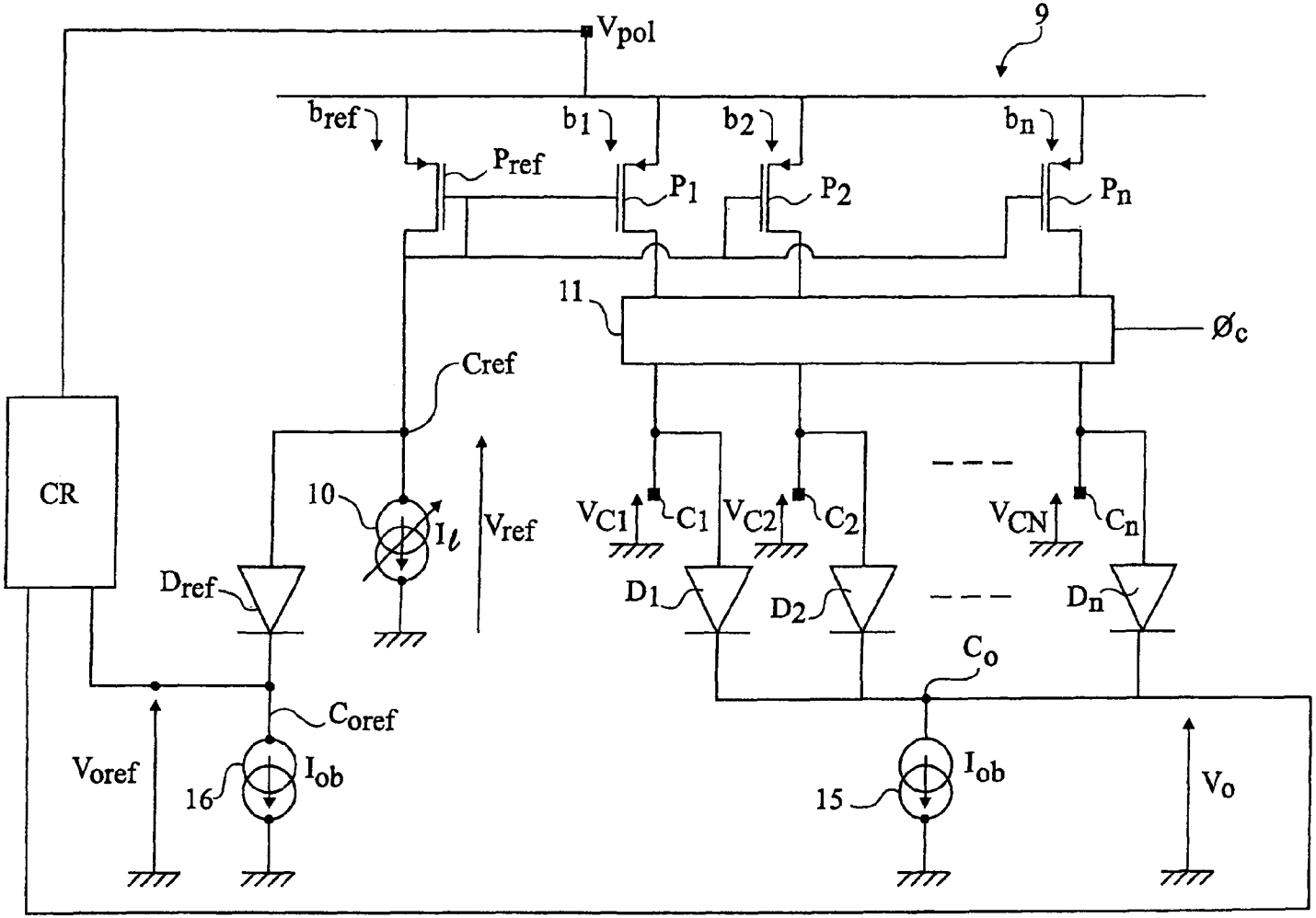
FIG. 3 illustrates an exemplary embodiment of the regulation device according to the present invention.

FIG. 3 is a diagram of an embodiment of column control circuits and of the device for regulating biasing voltage $V_{pol}$ according to the present invention. The column control circuits comprise a current mirror 9 formed of a reference branch $b_{ref}$ and of n duplication branches $b_1$ to $b_n$. Each branch is formed of a PMOS transistor, $P_{ref}$ for the reference branch and $P_1$ to $P_n$ for branches $b_1$ to $b_n$. The sources of the transistors of each of the branches are connected to biasing voltage $V_{pol}$ and the gates are connected to one another. The drain and the gate of transistor $P_{ref}$ of the reference branch are connected to a reference current source 10 at a node $C_{ref}$. Reference current source 10 provides a luminance current $I_1$. The drain of each transistor $P_i$, i ranging between 1 and n, is connected to a column $C_i$ of the screen via a column selection circuit such as described in relation with FIG. 2. All the column selection circuits are represented by a selection device 11 controlled by a column signal $\phi_C$.

Each column $C_1$, to $C_n$ is connected to the anode of a diode, respectively $D_1$ to $D_n$. The cathodes of diodes $D_1$ to $D_n$ are connected to a current source 15 at a node $C_o$. Current source 15 provides a so-called observation current $I_{ob}$ selected to be small as compared to the minimum luminance current. Further, connection node $C_{ref}$ is connected to the anode of a diode $D_{ref}$ identical to diodes $D_1$ to $D_n$, the cathode of diode $D_{ref}$ is connected at a node $C_{oref}$ to a current source 16 providing a current equal to observation current $I_{ob}$. Nodes $C_{ref}$ and $C_o$ are connected to two inputs of an adjustment circuit CR which provides biasing voltage $V_{pol}$.

As indicated previously, the LEDs may, even when run through by a same current, exhibit across their terminals different voltage drops. Especially, this voltage drop tends to increase when the LEDs age. The present invention aims at adjusting voltage $V_{pol}$ to take these voltage variations into account and ensure that the chosen luminance current $I_1$ flows through all the selected columns, $V_{pol}$ remaining as small as possible.

Diodes $D_1$ to $D_n$ corresponding to the selected columns tend to be conductive. However, the diode connected to the column having the highest voltage imposes voltage $V_o$ on the cathodes of diodes $D_1$ to $D_n$. The other diodes are thus not conductive since the voltage thereacross is smaller than their threshold voltage. Voltage $V_o$ is the image of the voltage on the column having the highest voltage shifted by diode threshold voltage. Similarly, voltage $V_{oref}$ at connection node $C_{oref}$ is the image of voltage $V_{ref}$ shifted by a diode threshold voltage.

When voltage $V_o$ is greater than voltage $V_{oref}$, this means that the current in at least one of the screen columns is smaller than the chosen luminance current $I_1$. Adjustment circuit CR then raises biasing voltage $V_{pol}$ until voltages $V_o$ and $V_{oref}$ are equal.

Conversely, when voltage $V_o$ is smaller than $V_{oref}$, this implies that the chosen luminance current $I_1$ does flow through all the selected columns but that voltage $V_{pol}$ is too high, which results in a power overconsumption. To make electric power savings, the adjustment circuit decreases biasing voltage $V_{pol}$ down to the minimum voltage $V_{pol}$ ensuring a flow of luminance current $I_1$ in all the selected columns.

Figure 4:
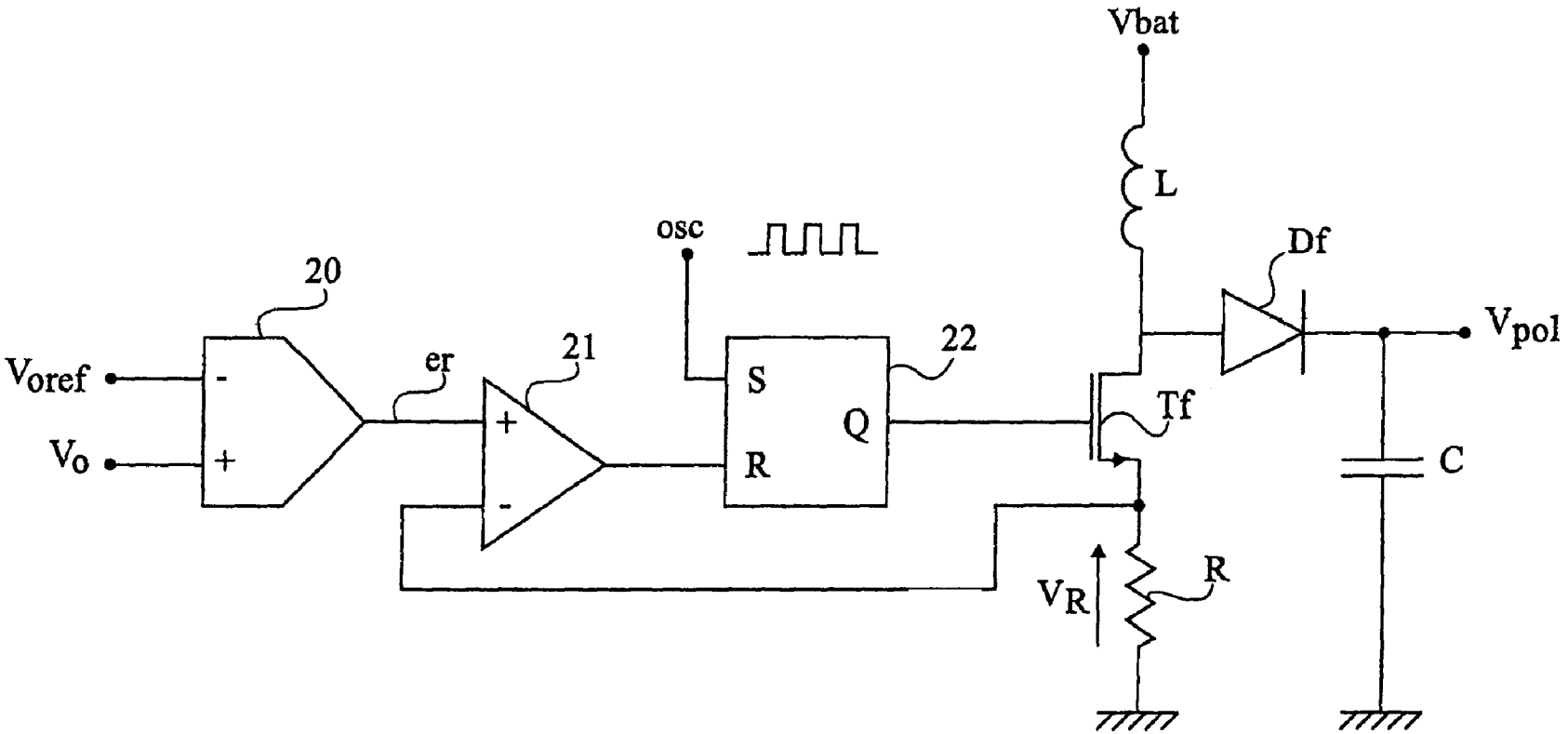
FIG. 4 illustrates a more detailed embodiment of the device of FIG. 3.

FIG. 4 is a diagram of the circuit for adjusting biasing voltage $V_{pol}$ according to the difference between voltages $V_o$ and $V_{oref}$.

The adjustment circuit comprises an error amplifier 20, an operational amplifier 21, and an RS flip-flop 22 operating with a low supply voltage, for example, 3.3 V. Error amplifier 20 receives on a positive input voltage $V_o$ and on a negative input voltage $V_{oref}$. In the case when the levels of voltages $V_o$ and $V_{oref}$ are very high for error amplifier 20, a voltage converter providing voltages proportional to voltages $V_o$ and $V_{oref}$ over a lower voltage range may be provided.

Error amplifier 20 amplifies the difference between $V_o$ and $V_{oref}$ and provides an error signal er which varies for example between 1 and 2 V. When voltages $V_o$ and $V_{oref}$ are equal, the error signal is for example 1.5 V. The higher voltage $V_o$ with respect to $V_{oref}$, the higher signal er, and conversely. Signal er is applied to the positive input of differential amplifier 21. The output of differential amplifier 21 is connected to reset terminal R of RS flip-flop 22. The output of an oscillator osc is connected to set terminal S of RS flip-flop 22. Terminal Q is at a high logic level (for example, 3.3 volts) when set terminal S is high and is at a low logic level (for example, 0 V) when reset terminal R is high. When both set terminal S and reset terminal R are low, output Q keeps the last positioned level.

The output of RS flip-flop 22 is connected to the gate of an NMOS transistor Tf. A resistor R is connected between the source of transistor Tf and the ground. A coil L is connected between the drain of transistor Tf and the supply terminal at a voltage $V_{bat}$, for example, at 3.3 V. The anode of a diode Df is connected to the drain of transistor Tf and its cathode is connected to a first electrode of a capacitor C. The second electrode of capacitor C is grounded. The first electrode of capacitor C provides voltage $V_{pol}$. The source of transistor Tf is connected to the negative input of differential amplifier 21.

On a rising edge of the signal of oscillator osc, output Q of RS flip-flop 22 switches high. Transistor Tf turns on and the voltage across coil L rapidly switches from 0 to $V_{bat}$. Voltage VR across resistor R and the current through coil L are initially zero. The current in coil L progressively increases, and voltage VR thus also increases. When voltage VR reaches signal er of differential amplifier 20, amplifier 21 switches high. Output Q of RS flip-flop 22 switches low and transistor Tf turns off. The voltage on the drain of transistor Tf abruptly increases. Diode Df turns on and capacitor C charges. The charge current is all the higher as the current flowing through coil L is high at the time when transistor Tf turns off.

At the next rising edge of oscillator osc, output Q of RS flip-flop 22 switches high again and a cycle identical to that previously described starts again.

When voltage $V_o$ is greater than voltage $V_{oref}$, signal er is relatively high. Accordingly, transistor Tf remains on longer and the current flowing through coil L at the turn-off time of transistor Tf is significant. Capacitor C charges and voltage $V_{pol}$ increases. Conversely, when voltage $V_o$ is smaller than voltage $V_{oref}$, voltage $V_{pol}$ decreases.

Biasing voltage $V_{pol}$ is thus adjusted according to the time variations of the voltage across the LEDs of the screen.

An advantage of the regulation device according to the present invention is that the biasing voltage is always minimum, which saves power.

Another advantage of such a device is that its design is very simple.

Of course, the present invention is likely to have various alterations, modifications, and improvements which will readily occur to those skilled in the art. In particular, other devices for evaluating the current flowing through the LEDs of the screen, as well as other devices for adjusting biasing voltage $V_{pol}$ according to the differences between the desired luminance current and the smallest current flowing through the LEDs of the screen, may be provided. Other D.C./D.C. voltage converters capable of providing a high biasing voltage $V_{pol}$ when error signal er is high and conversely may especially be used. Further, those skilled in the art will know how to make a current mirror different from that described, by using, for example, two transistors per branch.

Figure 5:
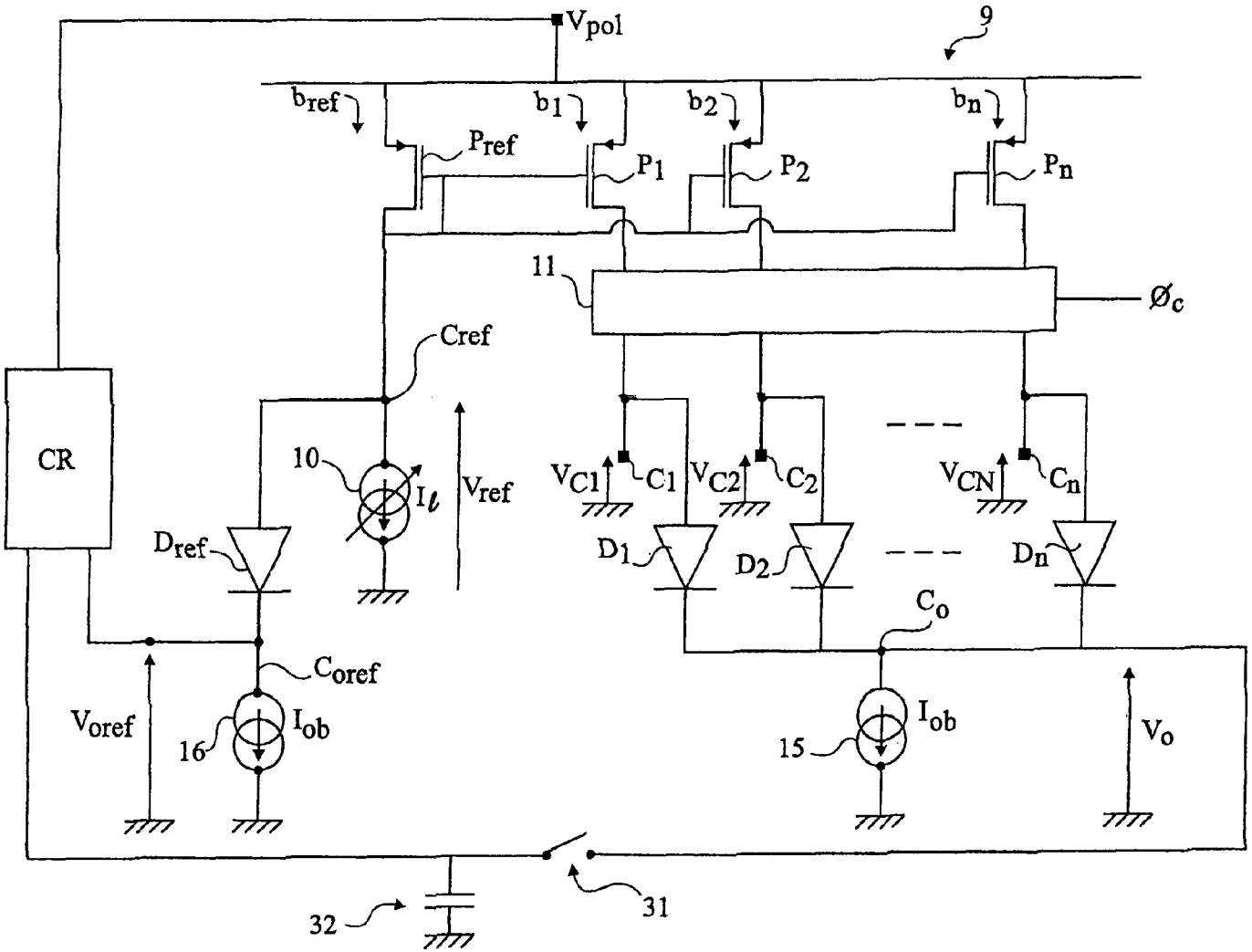
FIG. 5 illustrates another exemplary embodiment of the regulation device according to the present invention.

FIG. 5 illustrates column control circuits similar to those of FIG. 3, and a modified embodiment of the device for regulating biasing voltage $V_{pol}$ which solves the following problem. When a screen line is "black", meaning that no LED of the selected line is conductive, the voltage $V_o$ at node C□$C_o$ of the regulation circuit of FIG. 3 decreases because none of the diodes $D_1$ to $D_n$ is on. When voltage $V_o$ decreases, the adjustment circuit CR decreases biasing voltage $V_{pol}$. When a large number of consecutive screen lines are black, the biasing voltage $V_{pol}$ can strongly decrease. The conductive LEDs of bright lines may receive a current lower than the luminance current. The global luminance of the screen decreases.

In this modified embodiment, the device for regulating the biasing voltage $V_{pol}$ is similar to the one of FIG. 3, except that the node $C_o$ is linked to the adjustment circuit CR by a switch 31. Besides, a capacitor 32 is connected between the input of adjustment circuit CR and ground. Switch 31 is controlled so as to be non conductive when a screen line is black, i.e. when no LED of the selected line is conductive. Capacitor 32 holds the value of the voltage $V_o$ corresponding to the last non-black line. The switch control device, not shown, analyzes the column signal $\phi_c$ to detect if at least one column is selected, meaning that at least one diode is conductive. Moreover, according to a more sophisticated embodiment, the switch control device analyzes the control signals of the line control circuits in such a way that switch 31 is turned on once the voltages of selected columns have changed from their precharge voltages to their operating voltages corresponding to the voltages induced by each one of the conductive LEDs.

An advantage of such a regulation device is that it is possible to adjust the biasing voltage $V_{pol}$ according to the features of the LEDs of the screen whatever the number of consecutive black screen lines is.

Figure 6:
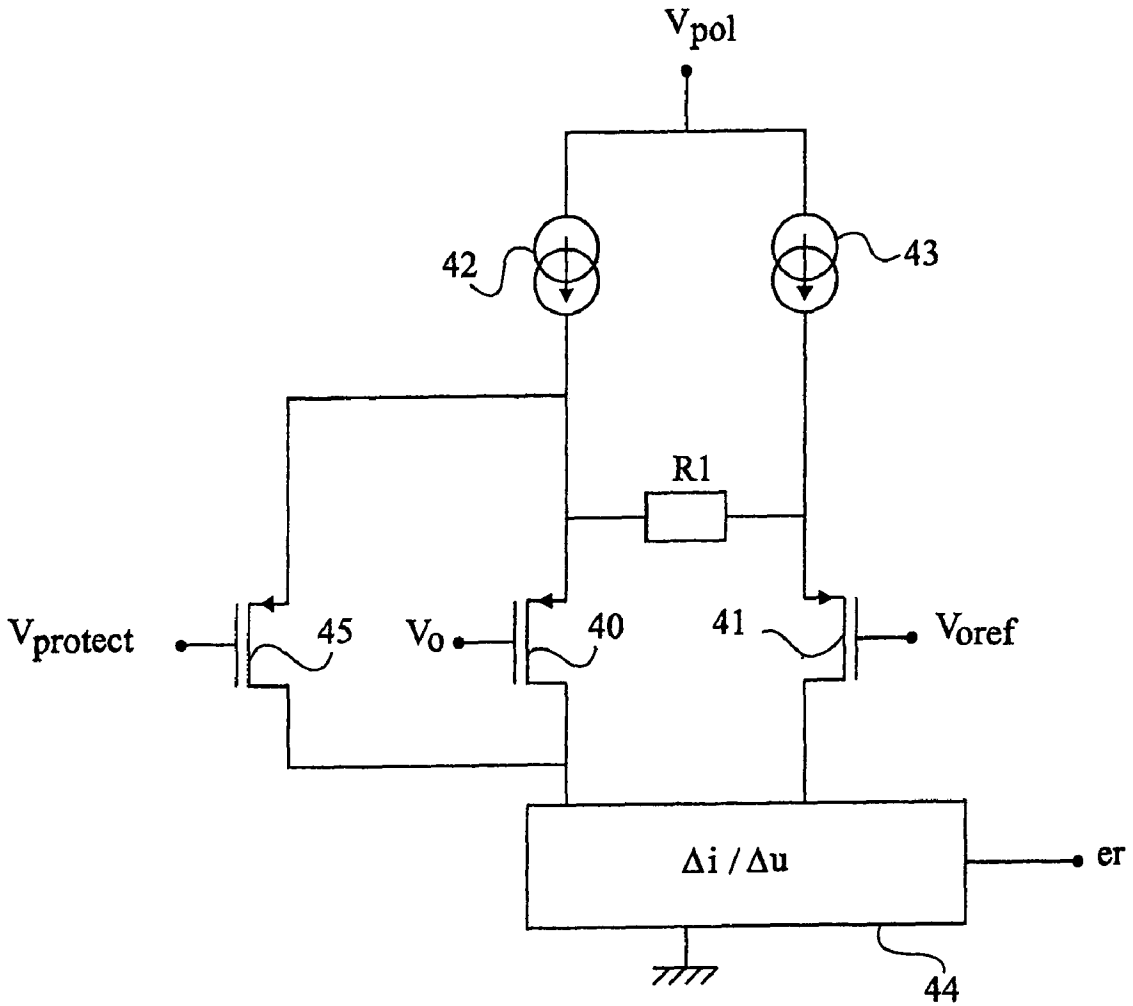
FIG. 6 illustrates an embodiment of one element of the device of FIG. 4.

FIG. 6 is a diagram of an embodiment of the error amplifier 20 of the adjustment circuit CR of FIG. 4 which solves the following problem. When the screen or the column or line control circuits include manufacture defects, or an aging defect, corresponding to a cut between the LED and a column or a line, the voltage $V_o$ can be very close to the biasing voltage $V_{pol}$. Such a defect leads not only to a drastic increase of the biasing voltage $V_{pol}$, but also to overvoltages likely to damage the adjustment circuit CR. In case of an aging defect, it can be interesting to detect the defect in order to avoid damaging the rest of the circuit and to avoid increasing the power consumption to produce a high voltage $V_{pol}$. The detection of a manufacture defect enables the detection of failing circuits before commercialization.

The error amplifier represented in FIG. 6 includes two PMOS transistors 40 and 41 the gates of which receive voltages $V_o$ and $V_{oref}$ respectively from the regulation device represented in FIG. 3. Two identical current sources 42 and 43 are connected between the biasing voltage source $V_{pol}$ and the sources of transistors 40 and 41. A resistor R1 is connected between the sources of transistors 40 and 41. The drains of transistors 40 and 41 are linked to a conversion device 44, which provides the error signal er. A PMOS transistor 45 is connected in parallel with the transistor 40. The source of transistor 45 is connected to the source of transistor 40 and the drain of transistor 45 is connected to the drain of transistor 40. The gate of transistor 45 receives a "protection" voltage $V_{protect}$ which is produced by a device not shown. The protection voltage $V_{protect}$ corresponds to the maximum voltage $V_o$ corresponding to a correct operation of the screen and of the column and line control circuits.

During normal operation, with no defect in the circuit, the voltage $V_o$ is lower than protection voltage $V_{protect}$. Transistors 40, 41 and 45 conduct a current equal to the current provided by current sources 42 and 43, their gate-source voltages being substantially equal to the threshold voltage of a PMOS transistor. Thus, when voltage $V_o$ is lower than voltage $V_{protect}$, transistor 45 is non conductive. Similarly, when voltages $V_o$ and $V_{oref}$ are different, voltages on the sources of transistors 40 and 41 are different. The current flowing through resistor R1 increases when the difference between voltages $V_o$ and $V_{oref}$ increases. Conversion device 44 analyzes the current differences in transistors 40 and 41 and provides an error signal er which is high when the current in transistor 40 is low compared to the current in transistor 41 and conversely.

When the circuit has a defect, voltage $V_o$ can be very close to biasing voltage $V_{pol}$. When voltage $V_o$ is higher than the protection voltage $V_{protect}$, transistor 45 is turned on and transistor 40 off. The biasing voltage $V_{pol}$ is then maximum. The maximum value of voltage $V_{pol}$ depends upon the choice of voltage $V_{protect}$ and voltage $V_{oref}$ which varies according to the desired luminance current. Thanks to transistor 45, it is sure that biasing voltage $V_{pol}$ will not go over a maximum given value, and overvoltages which could damage adjustment circuit CR are suppressed.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A device for regulating the biasing voltage of column control circuits of an array screen made of LEDs distributed in lines and columns, the column control circuits comprising a current mirror having a reference branch and several duplication branches connected to the biasing voltage, each duplication branch being coupled to a column of the screen, the reference branch being connected at a reference node to a reference current source providing a desired luminance current, said device comprising:

first measuring means coupled to the columns to measure a plurality of individual column voltages and provide a first signal representative of a maximum of the plurality of individual column voltages;

second measuring means providing a second signal representative of the voltage of the reference node; and an adjustment circuit receiving the first and second signals and being adapted to increase the biasing voltage when the first signal is higher than the second signal and conversely;

wherein the first measuring means comprises, for each column, a first diode having an anode connected to the column and a cathode connected to a first input of the adjustment circuit;

wherein the cathodes of the first diodes are connected to the first input of the adjustment circuit by a switch, a capacitor being connected to the first input of the adjustment circuit;

wherein the switch is controlled so as to be non-conductive when a screen line is black and no LED of the screen line is conductive; and wherein the capacitor holds a value of a voltage of a non-black screen line when the switch is non-conductive.

2. The device of claim 1, wherein each branch of the current mirror includes a PMOS field effect transistor, having a source connected to the biasing voltage, the gates of each branch being connected together, the drain and the gate of the transistor of the reference branch being connected to the reference current source, the drains of the transistors of the duplication branches being connected to the columns.

3. The device of claim 1, wherein said first diode is connected by its cathode to a first observation current source, and wherein a second diode is connected by its cathode to a second observation current source.

4. The device of claim 3, wherein the adjustment circuit comprises an error amplifier receiving the first signal on a positive input and receiving the second signal on a negative input, an output of the error amplifier being connected to a D.C./D.C. voltage converter outputting the biasing voltage and being adapted to increase the biasing voltage when the first signal is higher than the second signal and conversely.

5. The device of claim 4, wherein the error amplifier comprises first and second PMOS transistors having their gates respectively connected to positive and negative inputs of the error amplifier, the source of each one of the first and second transistors being connected to the biasing voltage by a current source, the sources of first and second transistors being connected by a resistor, the drains of first and second transistors being connected to a converter providing the error signal, the source and drain of a third PMOS transistor being connected to the source and drain of the first transistor, the gate of the third transistor being connected to a fixed voltage.

6. A method for regulating the biasing voltage of column control circuits of an screen array made of LEDs distributed in lines and columns, the column control circuits comprising a current mirror having a reference branch and several duplication branches connected to the biasing voltage, each duplication branch being coupled to a column of the screen, the reference branch being connected at a reference node to a reference current source providing a desired luminance current, comprising the following steps:

providing a first signal representative of a maximum of a plurality of measured individual column voltages;

providing a second signal representative of the voltage at the reference node; and increasing the biasing voltage when the first signal is higher than the second signal and conversely;

wherein the first signal is provided by first diodes each having an anode connected to a different column of the screen; and wherein the first signal is provided by a switch coupled to the cathodes of the first diodes, wherein the switch is controlled so as to be non-conductive when a screen line is black and no LED of the screen line is conductive, such that a capacitor provides a value of a voltage of a non-black screen line to control the biasing voltage when the switch is non-conductive.

7. The method of claim 6, wherein the first signal is an image of the maximum voltage of the activated LEDs.

8. A circuit for regulating a biasing voltage of a display screen, the display screen having a plurality of columns coupled to the biasing voltage, the circuit comprising:

a first measuring circuit that measures a plurality of individual column voltages of the plurality of columns and provides a first signal representative of a maximum of the plurality of individual column voltages, wherein the first measuring circuit comprises a plurality of diodes individually coupled to a respective column of the plurality of columns;

a control circuit that regulates the biasing voltage based on the first signal and a reference signal;

a switch coupled to the plurality of diodes and an input of the control circuit, the switch being controlled to be turned off when the plurality of diodes are turned off, the switch being controlled to be turned on when one or more of the plurality of diodes is turned on; and a capacitor coupled to the input of the control circuit that supplies a value of a voltage of a non-black screen line to the input of the control circuit when the switch is turned off.

9. The circuit of claim 8, wherein the control circuit is configured to increase the biasing voltage when the first signal is higher than the reference signal.

10. The circuit of claim 8, wherein the control circuit is configured to decrease the biasing voltage when the first signal is lower than the reference signal.

11. The circuit of claim 8, wherein the plurality of diodes have first terminals individually coupled to a respective one of the columns.

12. The circuit of claim 11, wherein the first terminals of the plurality of diodes are anodes, and wherein the plurality of diodes have second terminals coupled to an observation current source and to the control circuit.

13. The circuit of claim 8, wherein the control circuit comprises:

an error amplifier receiving the first signal and the second signal; and a D.C./D.C. voltage converter that regulates the biasing voltage based on an output of the error amplifier.

14. The circuit of claim 13, wherein the error amplifier is configured to limit the biasing voltage to no higher than a maximum biasing voltage.

15. A method for regulating a biasing voltage of a display screen, the display screen having a plurality of columns coupled to the biasing voltage, the method comprising:

providing a first signal representative of a maximum voltage of a plurality of measured individual column voltages of the plurality of columns, the first signal being provided by diodes individually coupled to the plurality of columns;

regulating the biasing voltage based on the first signal; and when the plurality of columns of the display screen are turned off, regulating the biasing voltage using a capacitor that stores a value of a voltage of a non-black screen line and not regulating the biasing voltage based on the first signal.

16. The method of claim 15, wherein the regulating of the biasing voltage is performed by comparing the first signal and a reference signal.

17. The method of claim 16, wherein the regulating of the biasing voltage comprises increasing the biasing voltage when the first signal is higher than the reference signal.

18. The method of claim 16, wherein the regulating of the biasing voltage comprises decreasing the biasing voltage when the first signal is lower than the reference signal.

19. The method of claim 15, further comprising:

coupling the diodes to a control circuit when at least one of the first diodes is on, wherein the control circuit regulates the biasing voltage; and decoupling the first diodes from the control circuit when all of the diodes are off.

20. The method of claim 15, wherein the regulating of the biasing voltage comprises limiting the biasing voltage to a voltage no higher than a maximum biasing voltage.

21. The method of claim 15, further comprising:

providing an observation current to the diodes using an observation current source coupled to the diodes to generate the first signal between the diodes and the observation current source.

22. The circuit of claim 8, wherein the biasing voltage is regulated by comparing the first signal with a reference signal, wherein the reference signal is generated by a reference diode that is substantially identical to the plurality of diodes.

* * * * *

UNITED STATES PATENT AND TRADEMARK OFFICE

CERTIFICATE OF CORRECTION

PATENT NO. : 7,755,580 B2
APPLICATION NO. : 10/917846
DATED : July 13, 2010
INVENTOR(S) : Céline Mas et al.

It is certified that error appears in the above-identified patent and that said Letters Patent is hereby corrected as shown below:

Col. 2, line 24 should read:
--requires for biasing $V_{pol}$ to be at least equal to the--
line 61, should read:
--To achieve these and other objects, the present invention provides a--
line 63, should read:
--circuits of an array screen made of LEDs distributed in lines--

Col. 4, line 9, should read:
--cuit and a line control circuit addressing an LED of a screen;--

Signed and Sealed this

Seventeenth Day of August, 2010

David J. Kappos

David J. Kappos
*Director of the United States Patent and Trademark Office*